US007877830B1

(12) United States Patent
Koehl et al.

(10) Patent No.: US 7,877,830 B1
(45) Date of Patent: Feb. 1, 2011

(54) METHOD AND APPARATUS FOR ATTACHING A HEEL TO A SHOE

(76) Inventors: Timothy D. Koehl, 4817 Taft Park, Metairie, LA (US) 70002; Joseph R. Mackenroth, III, 4531 Utopia Dr., Metairie, LA (US) 70001

( * ) Notice: Subject to any disclaimer, the term of this patent is extended or adjusted under 35 U.S.C. 154(b) by 1216 days.

(21) Appl. No.: 11/440,514

(22) Filed: May 25, 2006

(51) Int. Cl.
*A43D 71/00* (2006.01)
*A43D 69/00* (2006.01)

(52) U.S. Cl. ..... 12/42 B; 227/28; 227/152

(58) Field of Classification Search ..... 12/42 R, 12/42 B; 227/28, 29, 40, 152, 154
See application file for complete search history.

(56) References Cited

U.S. PATENT DOCUMENTS 2,878,523 A * 3/1959 Hardy ..... 264/244
3,601,908 A 8/1971 Gilkerson
4,053,095 A 10/1977 Coleman
4,404,757 A * 9/1983 Sweeny ..... 36/107
4,480,778 A 11/1984 Giebel
4,491,263 A 1/1985 Broning
5,675,916 A 10/1997 Lewis

* cited by examiner

*Primary Examiner*—Jila M Mohandesi
(74) *Attorney, Agent, or Firm*—Kenneth L. Tolar

(57) ABSTRACT

A method and apparatus for more accurately fastening a raised heel to a shoe outsole includes a shoe support column having an impact head at an upper end thereof. The impact head is contoured to substantially conform to the inner heel portion of the shoe upper. The impact head includes a plurality of bores each having a piston-operated driver therein that propels a nail upwardly through the shoe insole and into the raised heel. Proximal the bore outlets is an alignment button that is inserted into a channel formed through the shoe insole and outsole. An alignment pin is positioned within both an alignment aperture formed on the shoe heel and a centrally disposed cavity on the button. When the alignment aperture, button and channel are axially aligned, the raised heel is properly positioned on the shoe outsole ensuring accurate penetration of the nails.

2 Claims, 1 Drawing Sheet

METHOD AND APPARATUS FOR ATTACHING A HEEL TO A SHOE

CROSS REFERENCE TO RELATED APPLICATIONS

None.

BACKGROUND OF THE INVENTION

The present invention relates to a method and apparatus for attaching a heel to a shoe.

DESCRIPTION OF THE PRIOR ART

Conventional methods of attaching a raised heel to a shoe sole include using a pneumatically driven piston that thrusts nails through the insole, the outsole and the raised heel. While the nails are being driven, the shoe is supported by an impact head that is contoured to substantially conform to the inner heel portion of the shoe "upper" to properly orient the nails relative the insole and outsole. Once the head is positioned within the upper, the raised heel is manually aligned with the outsole and is held in place with a clamp. However, the alignment is often inaccurate or the shoe and/or heel moves during installation. If so, the nails may penetrate the heel at an angle or at randomly varying positions from one shoe to the next resulting in inconsistent quality. Furthermore, the nails may protrude from or circumvent the heel requiring both the shoe and heel to be discarded. At the very least, improper nail penetration can result in a tenuous attachment of the heel enhancing the likelihood of breakage and subsequent accidents. Therefore, there is currently a need for a more efficient and accurate means of securing a raised heel to a shoe.

A review of the prior art reveals numerous methods and apparatuses for attaching a heel to a shoe. For example, U.S. Pat. No. 5,675,916 issued to Lewis discloses a shoe having a heel that can be interchangeably attached to the heel portion of the shoe outsole by extending a large bolt through an opening on the rear portion thereof. A sleeve received within a recess on a top end of the heel threadedly engages the bolt.

U.S. Pat. No. 4,053,095 issued to Coleman discloses a heel attaching machine similar to that described, supra, that includes a piston driven impact head having an inclined staple receiving slot thereon. The impact head simultaneously drives nails and a staple into the heel whereby the staple angularly extends into a rear portion of the heel and inclines toward the center thereof.

U.S. Pat. No. 4,491,263 issued to Bröning discloses a heel attachment machine including an abatement member that is moved upwardly into engagement with the shank region of the shoe insole. The abatement member prevents the shoe upper from tipping about the edge of the nailing stand during insertion of the heel nail.

U.S. Pat. No. 4,480,778 issued to Giebel discloses a heel nailing machine having a clamp that prevents the heel from moving during attachment. The clamp may be moved upwardly to lift the shoe and attached heel from the stand. The clamp is pivoted to one side and the shoe is released to automatically eject the shoe from the machine.

U.S. Pat. No. 3,601,908 issued to Gilkerson discloses a molded insole adapted for use with one of several variable length high heels.

As indicated above, various heel attachment machines exist in the prior art. However, none of the above-referenced patents disclose a means for accurately aligning a raised heel with the heel portion of a shoe outsole to accurately attach the heel according to the present invention.

SUMMARY OF THE INVENTION

The present invention relates to a method and apparatus for more accurately fastening a raised heel to a shoe outsole including a shoe support column having an impact head at an upper end thereof. The impact head is contoured to substantially conform to the inner heel portion of the shoe upper. The impact head includes a plurality of bores each having a piston-operated driver therein that propels a nail upwardly through the shoe insole and outsole and into the raised heel. Proximal the bore outlets is an alignment button that is inserted into a channel formed through the shoe insole and outsole. An alignment pin is positioned within both an alignment aperture formed on the shoe heel, and a centrally disposed cavity on the button. When the alignment aperture, button and channel are axially aligned, the raised heel is properly positioned on the shoe outsole ensuring accurate penetration of the nails.

It is therefore an object of the present invention to provide a device that more accurately attaches a raised heel to a shoe.

It is another object of the present invention to provide a method of attaching a raised heel that minimizes inaccuracies and wastage associated with conventional methods.

Other objects, features, and advantages of the present invention will become readily apparent from the following detailed description of the preferred embodiment when considered with the attached drawings and the appended claims.

DESCRIPTION OF THE PREFERRED EMBODIMENT

The present invention relates to a method and apparatus for attaching a raised heel to a shoe. The present invention is particularly useful for securing a heel plate to a heel portion of a shoe outsole for the type of shoe described in U.S. Pat. No. 5,058,290, the specification of which is incorporated herein by reference. Such shoe includes a heel plate that is fixedly secured to the shoe outsole at the heel portion thereof. The heel plate includes a wide-profile, U-shaped slot formed thereon that slidably receives a U-shaped tongue on the upper end of the interchangeable heel to form a dovetail type joint. The heel plate includes an elevated peripheral portion that surrounds the slot into which nails are driven to secure the plate to the shoe outsole. The slightest inaccuracy in aligning the raised peripheral portion with the nails can result in the nails extending into the slot rendering the dovetail joint, and thus the shoe useless. In addition to the above described shoe, the method and apparatus according to the present invention may be used to accurately attach any type of raised heel, or interchangeable heel attachment plate, directly to a shoe.

Figure 1:
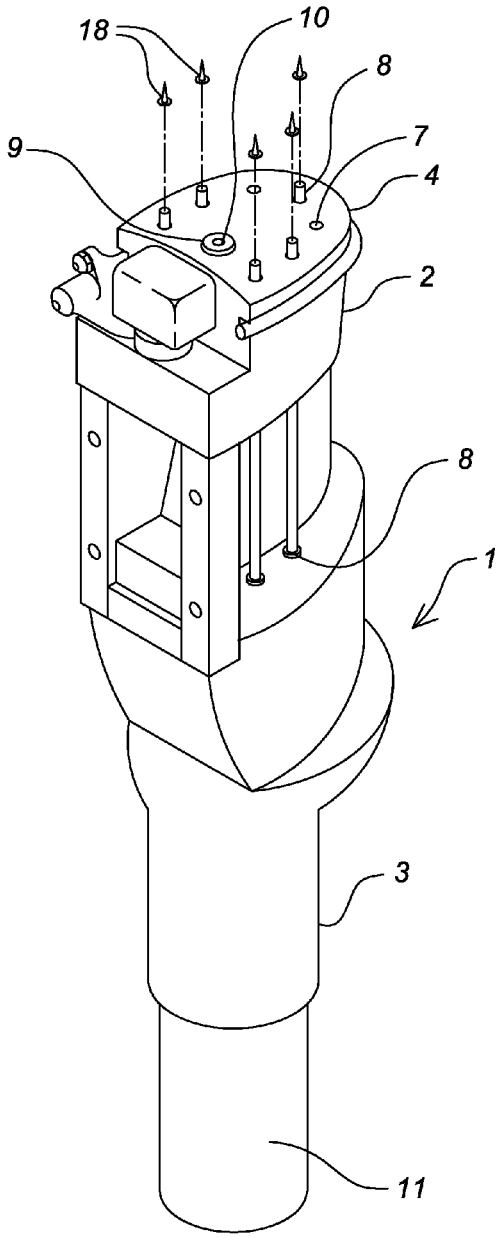
FIG. 1 is a perspective view of the nail attachment tool according to the present invention.
Figure 3:
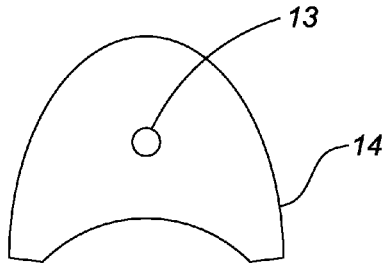
FIG. 3 is a top view of a raised heel having the alignment aperture formed thereon.
Figure 2:
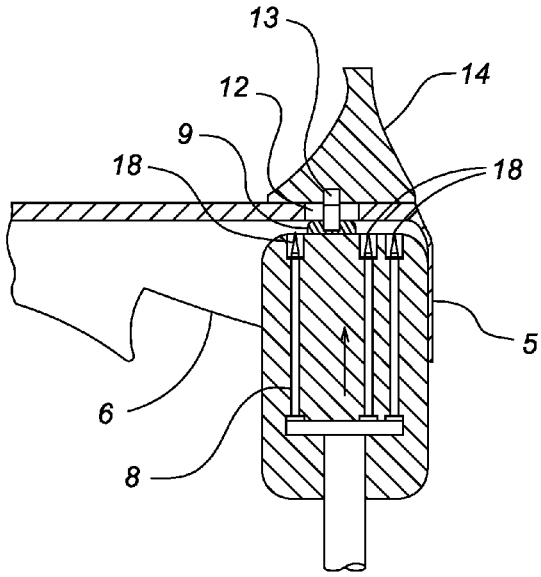
FIG. 2 depicts the method of properly aligning a raised heel, a shoe and the impact head.

Now referring to FIGS. 1-3, the apparatus according to the present invention includes an elongated shoe support column 1 having an upper end 2 and a lower end 3. At the upper end of the column is an impact head 4 having an arcuate peripheral edge that is configured to substantially conform to the inner heel portion 5 of the shoe upper 6. When installing a heel, a user places the shoe over the top of the impact head with the heel portion of the upper surrounding the head as depicted in FIG. 2.

The head includes a plurality of bores 7 for receiving nails 18 that fasten the raised heel 14 to the shoe. Likewise received within each bore and positioned immediately below each nail is a tubular driver 8 that, when thrust upwardly, simultaneously drives the nail through the insole, the outsole and the raised heel. On the upper surface of the impact head, proximal the nail receiving bores is an alignment button 9 having a centrally disposed cavity 10. The cavity receives an alignment pin to properly orient the raised heel relative to the outsole according to the method described, infra. A pneumatically driven piston 11 is telescopically received within the lower end of the support column and is fixedly attached to each of the drivers. Accordingly, actuation of the piston propels the drivers upwardly thereby thrusting the nails through the shoe and into the heel.

The method of attaching a raised heel to a shoe using the apparatus described above further includes forming an alignment channel 12 extending through the shoe insole and outsole, near the heel portion, that is dimensioned to tightly receive the alignment button. The alignment button and channel are positioned such that when the button is received within the channel, the impact head is properly positioned within the shoe upper.

The method further includes forming an alignment aperture 13 on the top end of the raised heel that is to be attached. The alignment aperture is positioned such that when it is axially aligned with the alignment button and channel, the raised heel (or heel plate for an interchangeable heel) is properly oriented relative to the shoe.

A user can properly align a raised heel with a shoe and subsequently attach the raised heel thereto as follows. The user places the alignment pin into the central cavity on the alignment button and the heel portion of the shoe upper is superimposed on the impact head with the alignment button received within the channel. The heel is positioned on the outsole such that the pin is received within the alignment aperture. Preferably, the heel is temporarily fastened to the outsole with hot melt glue to retain the heel in the aligned position during the attachment process. A nail machine clamp (not pictured) is tightly secured to the heel to further maintain it in alignment with the outsole. When the pneumatic piston is actuated, it thrusts the drivers upwardly thereby accurately thrusting each of the nails through the shoe and into the perfectly aligned raised heel.

The above described device is not limited to the exact details of construction provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. In combination with a shoe having an alignment channel formed through both an insole and an outsole, and a heel having an alignment aperture formed thereon, an apparatus for attaching said heel to said shoe comprising:

an elongated shoe support column having an upper end and a lower end;

an impact head at the upper end of the column, said head having an arcuate peripheral edge that is configured to substantially conform to an inner heel portion of said shoe, said impact head further including a plurality of bores for receiving nails that fasten said heel to said shoe, each of said bores having a driver received therein;

a pneumatic piston operably connected to said drivers for propelling said drivers to thrust nails resting thereon through said insole, said outsole and said heel;

an alignment button proximal the bores and received within said alignment channel.

2. The apparatus according to claim 1 further comprising:

a cavity centrally-disposed on said alignment button;

a pin received within said cavity and said alignment aperture to properly align said heel with a portion of said shoe.

* * * * *